US005690759A

United States Patent [19]

Wang

[11] Patent Number: 5,690,759

[45] Date of Patent: Nov. 25, 1997

[54] COATED PERMANENT MOLD HAVING TEXTURED UNDERSURFACE

[75] Inventor: Yucong Wang, Saginaw, Mich.

[73] Assignee: General Motors Corporation, Detroit, Mich.

[21] Appl. No.: 668,883

[22] Filed: Jun. 24, 1996

[51] Int. Cl.[6] ..... B28B 7/36; B22C 3/00

[52] U.S. Cl. ..... 249/114.1; 164/138

[58] Field of Search ..... 164/138; 249/114.1, 249/116, 135

[56] References Cited

FOREIGN PATENT DOCUMENTS

3905829C1 4/1990 Germany .

63-79970 4/1988 Japan .

63-89652 4/1988 Japan .

63-96280 4/1988 Japan .

1703246 1/1992 U.S.S.R. .

*Primary Examiner*—Kuang Y. Lin

*Attorney, Agent, or Firm*—Lawrence B. Plant

[57] ABSTRACT

Mold for permanent mold casting having a RPVD ceramic coating atop a mold surface which is textured to provide a specific microtopography suitable for eliminating misruns in the casting.

4 Claims, 3 Drawing Sheets

COATED PERMANENT MOLD HAVING TEXTURED UNDERSURFACE

This invention relates to a mold for the permanent mold casting of aluminum, and more particularly to such a mold having a RPVD ceramic coating conforming to the microtopography of a textured surface of the molding cavity underlying the coating.

BACKGROUND OF THE INVENTION

Permanent mold casting involves gravity pouring molten metal into a permanent (i.e., reusable) mold made of a metal such as a heat resistant steel (e.g., H-13) or a titanium alloy (e.g., Ti-6A1-4V). It is known to coat the molding cavities of permanent, molds to protect, insulate, and/or lubricate the molding surface, and to prevent the metal from sticking thereto. For example, it is known to (1) spray the molding surface with a water-based, or solvent-based, ceramic slurry comprising a binder (e.g., sodium silicate) and such ceramics as alumina, silica, magnesia, zircon, calcium oxide, zinc oxide or combinations thereof, and (2) dry the coating to bind the ceramic particles together by means of the binder. Such water/solvent-based coatings: (1) are typically about 70 microns (μ) to about 300μ thick, and mask the microtopography of the underlying surface; (2) are porous; (3) are short-lived in that they flake off or spall, and require relatively frequent touch-up/repair/replacement; (4) impart a rough finish to the casting; (5) produce casting defects (e.g., porosity) in the castings as a result of water/solvent escaping from coatings which have not completely dried before casting commences; and (6) produce nonuniform coating thicknesses at different sites of the mold cavity surface.

It is also known to replace the slurry coating with a reactively physical vapor deposited (i.e., RPVD) ceramic coating. For example, Japanese Patent 63-96280 discloses a RPVD titanium nitride (TiN) coating atop an electrodeposited chromium undercoating. RPVD coatings are thin, are more durable/long-lived than slurry coating(s), and require less maintenance than slurry coatings. RPVD ceramic coatings suitable for coating permanent molds include TiN, CrN, CrC, $B_4C$, and TiAlN. A preferred RPVD ceramic coating, titanium aluminum nitride (TiAlN), is the subject of my copending U.S. patent application Ser. No. 08/668,882 filed concurrently herewith and assigned to assignee of the present invention. RPVD coatings, however, are susceptible to the formation of "misruns" on the surface of castings. "Misruns" are irregularities in the casting such as discontinuities or seam defects in a casting body typically caused by incomplete filling of the mold often due to low pouring or mold temperatures, inadequate venting or gating, and areas of the mold cavity surface which are too smooth for the aluminum to attach. Conventional wisdom for eliminating misruns due to smoothness is either to "roughen" the coatings in areas where misruns occur, or remove the coating in such areas and "roughen" the bare mold's surface, with the popular belief being that "the rougher the better".

SUMMARY OF THE INVENTION

According to the present invention, the bare (i.e., uncoated) metal mold (including mold inserts and the like) is provided with a specific textured surface in areas where misruns are likely, and the textured surface covered with a thin, conformal, RPVD ceramic coating designed to eliminate misruns. In this regard, I have found that simply "roughening" of the surface of a mold which is to be RPVD-ceramic coated does not reduce misruns. Rather, I have found that mold surfaces that are destined to be coated with a thin RPVD-ceramic coating must be textured in a specific manner (i.e., have a specific roughness profile) in order to be effective with the coating to prevent misruns when casting aluminum. Hence, the present invention provides a thin, substantially uniform dense, long-lived, RPVD ceramic coating on the molding cavity surface which coating conforms to the microtopography of a specific texture applied to the mold surface underlying the coating. While texturing is only needed at those localized areas of the mold surface where misruns tend to occur, the entire surface of the mold cavity could be textured without departing from the present invention.

More particularly, the present invention contemplates a permanent mold for the permanent mold casting of aluminum comprising a metal body having an inner surface defining a molding cavity wherein the inner surface (1) is textured to a particular microtopography/profile conducive to the elimination of misruns thereat, and (2) is then coated with a thin conformal coating of a reactively physical vapor deposited (RPVD) ceramic (preferably TiAlN for prolonged life). The coating will be at least about two (2) microns (μ) to about 20μ thick. Above about 20μ thickness, the ability of the coating to substantially precisely replicate the underlying textured surface is lessened, and the likelihood of misruns occurring increases. Moreover, coating adhesion tends to decrease as coating thickness increases above 15μ. As a practical matter, the thickness need not exceed about eight (8) μ for most applications. Conformal ceramic coatings less than about 20μ, and particularly less than 8μ, precisely replicate the textured undersurface, and result in the elimination of misruns thereat. In accordance with the present invention, the textured surface underlying the RPVD coating will have a microtopography comprising a plurality of peaks and valleys characterized by a Talysurf profile having: (a) a mean line above and below which the area under said peaks and the area under said valleys are equal and a minimum; (b) a maximum height, $R_p$, of said peaks above said mean line of about 9μ to about 13μ; (c) a maximum depth, $R_v$, of said valleys beneath said mean line of about 9μ to about 15μ; (d) a roughness characteristic, $R_a$, of about 3μ to about 5μ which is the arithmetic mean of the departures of the profile from the mean line over the sampling length, and (e) a peak spacing at the mean line, $S_m$, of about 400μ to about 500μ which is the arithmetic mean of the sum of the spacings between the beginning of one peak and the beginning of the next peak at the mean line over the sampling length divided by the number of such spacings over the sampling length. RPVD coated molds having textured surfaces falling outside these ranges have consistently produced misruns.

DETAILED DESCRIPTION OF THE INVENTION

The invention will better be understood when considered in the light of the following detailed description thereof which is given hereafter in conjunction with the several drawings in which.

Figure 1:
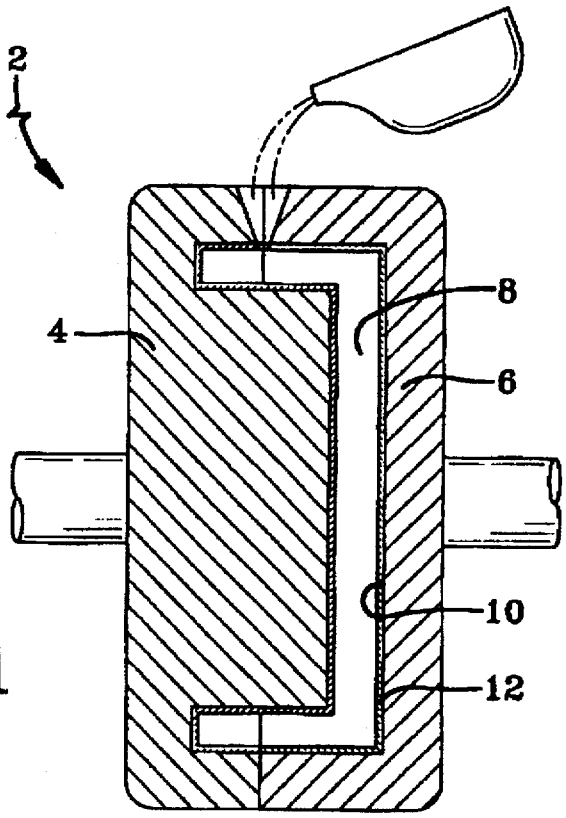
FIG. 1 is a side, sectional view of a RPVD ceramic coated permanent mold in accordance with present invention.

The present invention contemplates a mold for the permanent mold casting of aluminum having a molding cavity whose surface has a specified texture at locations thereof susceptible to causing misruns, and is coated with a thin (i.e., about 2μ to about 20μ), microconformal RPVD ceramic layer. The ceramic coating will preferably comprise titanium aluminum nitride owing to its long term durability and oxidation resistance. By "microconformal" is meant that the coating conforms substantially to the microtopography of the surface on which it is deposited so as to substantially replicate that underlying surface's profile (i.e., its contours, peaks and valleys), at the microscopic level. Hence a microconformal coating is distinguished from one which fills in the valleys, and effectively masks the profile peaks, as can occur with sprayed water/solvent-based coatings or RPVD coatings which are too thick. The molds themselves are made from heat resistant steel (e.g., H-13) or titanium alloys (e.g., Ti-6A1-4V alloys).

Physical vapor deposition (PVD) coating processes are well known in the art and involve film deposition from one or more sources under vacuum in the presence of an ionized inert gas (e.g., argon), by evaporation (including ion-plating) or sputtering techniques in which the source materials are ionized and attracted to an oppositely charged substrate to be coated. Reactive physical vapor deposition (RPVD) is similar to PVD, but a reactive gas (e.g., nitrogen or methane) is substituted for, or mixed with, the inert gas and reacts with the source material(s) ions to deposit the reaction product (e.g., a nitride) onto the surface. PVD and RPVD processes are well known in the art and are described in such texts as (1) Kirk-Othmer, *Encyclopedia of Chemical Technology*, Third Edition, John Wiley & Sons, New York, 1982, and (2) *Advanced Surface Coatings: A Handbook of Surface Engineering*, D. S. Rickerby & A. Matthews, published by Chapman and Hall, New York, 1991. Accordingly, they will not be described in detail herein.

Molds have successfully been coated with TiN and TiAlN using the arc evaporation variant of the RPVD process. Alternatively, the molds can be coated using the arc bond sputtering process. Molds have been successfully arc-evaporation coated with a ceramic using a multi-arc arc-evaporation PVD coater made by Multi-Arc Coatings Inc. The mold to be coated is placed in the vacuum chamber of a coater along with an appropriate number of targets (e.g., 2 or 3). Where the ceramic to be deposited is to contain two or more metal components (e.g., Ti and Al), each metal will have the same number of targets (e.g., 2Ti and 2Al) in the vacuum chamber. The mold is heated to a temperature of about 400° C. to about 450° C. before deposition commences. The source voltage and current for vaporizing the metals will be about 10 volts to about 40 volts, and about 50 amps to about 400 amps respectively. About 50% to about 80% of the Ti and Al atoms are ionized, and each will have a mean particle energy of about 50 eV to about 150 eV. The substrate voltage (i.e., bias between the targets and the mold), and current density will be about 100 volts to about 600 volts, and <7.5 mA/cm$^2$, respectively. The atmosphere in the vacuum chamber will be pure nitrogen at a pressure of less than about $1\times10^{-4}$ Torr. The RPVD coating will be deposited at a rate of about 1μ/hr to about 3μ/hr for about 2 to about 4 hours to a total thickness of about 2μ to about 8μ.

A clean surface is important to obtaining a good, strongly adherent coating. The surface of the mold will preferably be subjected to ultrasonic cleaning in an alkaline solution comprising 30 grams/liter of a mixture which, by weight, comprising 38% sodium hydroxide, 36% sodium carbonate, 12% metasilicate, 9% tetrasodium pyrophosphate, 3% fatty acid esters, 2% ethoxylated alkylphenol. Moreover, the surface will further be cleaned in the PVD coater by bombarding and etching the surface of the mold with gas ions just prior to commencing the RPVD deposition step.

In accordance with the present invention, all or selected areas of the surface of the mold cavity are textured to prevent "misruns" in those areas. Misruns do not occur in high pressure casting processes, such as diecasting, because the high filling speed and pressure effectively overcomes any influence the surface of the mold cavity might otherwise have on the metal flow. In permanent mold casting however, the filling speed and pressure are much lower and insufficient to overcome the mold surface effects on flow. It is known to "roughen" certain uncoated areas of a permanent mold to promote metal flow thereat, and adherence of metal thereto, in order to avoid misruns. Moreover, slurry coatings tend to inherently have a rough surface. Thin RPVD coatings, however, do not change or impart roughness to an otherwise smooth surface. Since thin (i.e., less than about 20μ), RPVD coatings conform to, substantially preserve, and replicate the microtopography of the underlying mold surface, they also replicate any roughness imparted to the undersurface. However, I have found that for RPVD coated molds, simply "roughening" the underlying surface of the molds too aggressively or in an indiscriminate, uncontrolled manner does not prevent misruns. Rather, I have found that for RPVD coated surfaces to be effective in controlling misruns, the underlying mold surface must be textured in a very particular manner.

Figure 3:
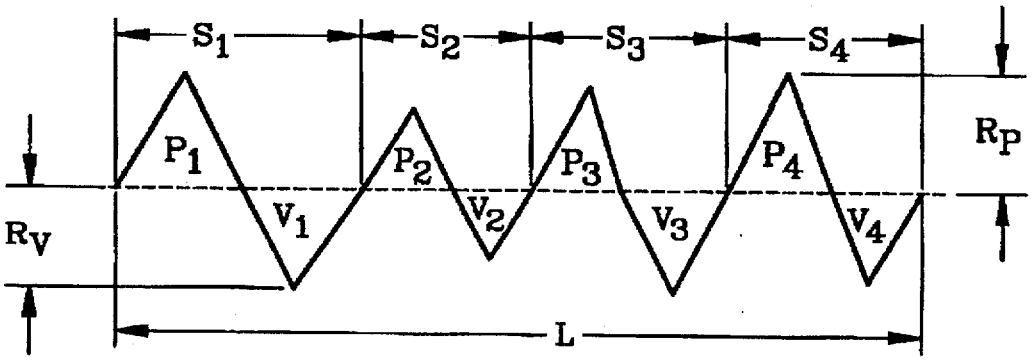
FIG. 3 shows some of the Talysurf parameters used to characterize a surface superimposed onto an illustrated microtopographical roughness profile of a surface.

Textured mold surfaces useful to prevent misruns in RPVD ceramic coated molds are characterized by a certain microtopography or profile as determined by Talysurf measurements. Talysurf measurements are made by traversing a stylus across the surface to be measured over a sampling length such that the stylus accurately traces the outline of every peak and valley it encounters. The stylus is normally either conical with a spherical tip, or a four-sided pyramid with a truncated tip. Measurements taken in connection with this invention were taken using a Form Talysurf machine over a sampling length of about 4.3 millimeters using a conical tip having a five-micrometer radius coupled to a pickup rigidly affixed to a shaft which moves in an accurate straight line according to the so-called "independent datum" method. Three such measurements were taken one (1) mm apart from each other, and the results averaged. Talysurf profiles are then defined and the surface characterized by a plurality of parameters which are calculated and reported out by the Talysurf machine. The most significant of such parameters for characterizing a surface for misrun prevention purposes, are the so-called $R_p$, $R_v$, $R_a$ and $S_m$, values which are reported relative to a so-called "mean line" (ML). The "mean line" is a line which bisects the profile such that the area above it and below it are equal and a minimum. FIG. 3 is a draftsman's illustration of a Talysurf profile labeled for use in connection with the following description. $R_p$ is the maximum height of the profile above the mean line (ML) within the sampling length (L). $R_v$ is the maximum depth of the profile below the mean line (ML) within the sampling length (L). $R_a$ is the international parameter of roughness, and is the arithmetic mean of the departures of the profile from the mean line (ML), and is a function of the total areas under the peaks $P_1$, $P_2$, $P_3$ and $P_4$, and valleys $V_1$, $V_2$, $V_3$ and $V_4$ over the sampling length. $S_m$ is the mean spacing between profile peaks $P_1$, $P_2$, $P_3$ and $P_4$, at the mean line, measured over the sampling length. More specifically, $S_m$ is the sum of the spacings $S_1$, $S_2$, $S_3$, and $S_4$ divided by the number of such spacings (here 4) over the sampling length (L).

In accordance with the present invention all, or some, of the mold cavity surface underlying the RPVD coating will be textured so as to provide a $R_p$ between about 9μ to about 13μ, a $R_v$ between about 9μ and about 15μ, a $R_a$ between about 3μ and about 5μ, and a $S_m$ between about 400μ and about 500μ.

A preferred technique for texturing the mold surface for misrun elimination is a multi-stepped process involving introducing spherical silica glass beads into a stream of compressed air which is directed through a nozzle onto the mold surface. A conventional shot-peening machine such as a Model No. BNP65 Dryblast Machine made by the Zero Manufacturing Company can be used for this purpose. Process parameters affecting texturing include: [a] the size of the glass beads (i.e., about 40 to about 325 mesh); [b] air-stream pressure (i.e., about 60 to about 100 psi); [c] nozzle diameter (about 13 millimeters); [d] flow rate of shot through nozzle (i.e., about 2.5 kg/min. to about 4.5 kg/min.); [e] distance from the nozzle to the mold surface (about 80 millimeters to about 170 millimeters); [f] exposure time (i.e., about 2 minutes to about 8 minutes); and [g] the impingement angle of the stream against the surface (i.e., about 80% to about 90%). When all other variables are fixed, the texturing intensity of the glass bead stream is governed by the air pressure, the particle size and the duration of exposure to the bead stream. Areas of the mold surface which are not to be textured will be suitably shielded from impact by the glass beads, preferably by means of a rubber mask.

Figure 2:
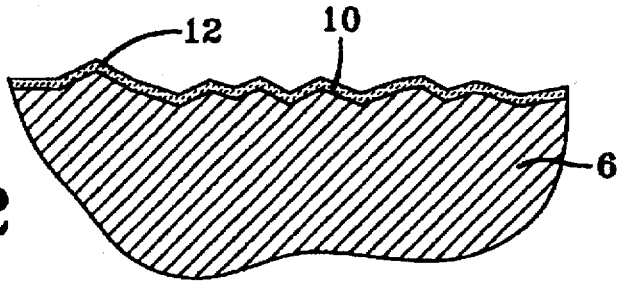
FIG. 2 is a draftsman's illustration of a magnified view of a portion of FIG. 1, at site 2 thereof, and showing the microtopography of the surface.

FIG. 1 depicts a permanent mold 2 comprising a male half 4 and female half 6 which, in the closed position, define a molding cavity 8. The molding cavity 8 is defined by mold surfaces 10 which are coated with a thin layer 12 of RPVD ceramic (e.g., TiAlN). FIG. 2 is a magnified portion of FIG. 1, where indicated, and shows the layer 12 conforming to the microtopography of the surface 10.

FIG. 3 illustrates the topography or profile of a surface, and shows thereon the values used to discriminate one profile from the next.

Figure 5B:
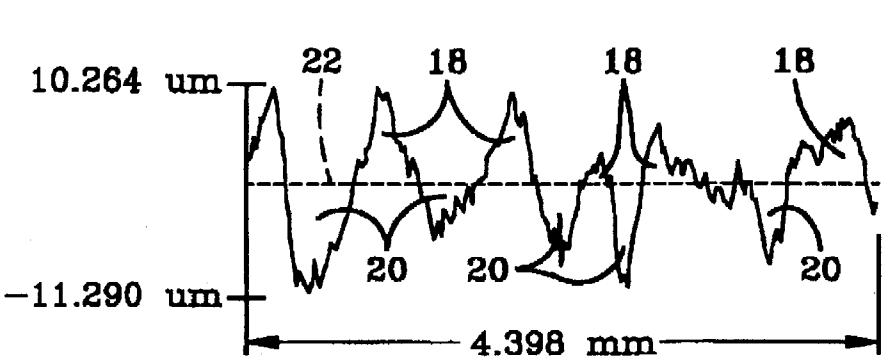
FIG. 5B is a Talysurf profile of the textured mold cavity surface at site 5A.
Figure 5A:
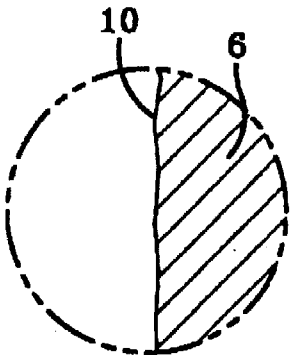
FIG. 5A is a magnified portion of a textured surface at site 5A of FIG. 4.
Figure 4:
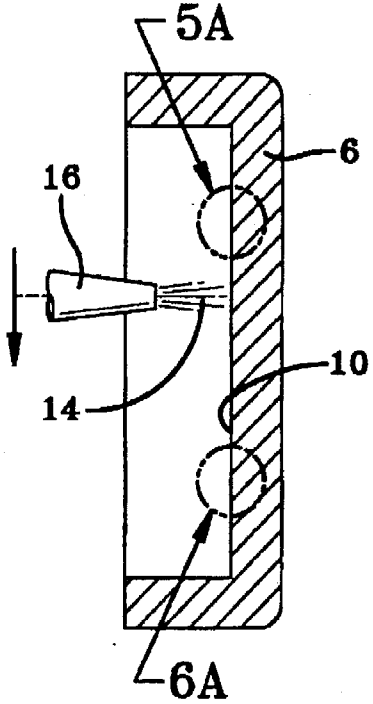
FIG. 4 illustrates, in side sectional view, a blasting technique for texturing a portion of the surface of the female halve of the mold of FIG. 1.
Figure 5C:
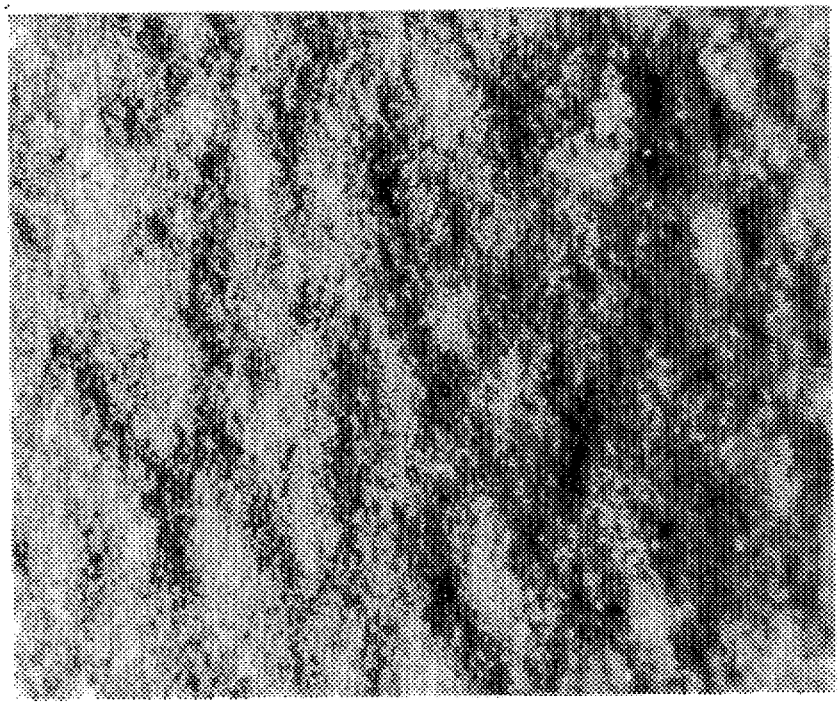
FIG. 5C is a photomicrograph showing the surface 5A at 20×magnification.

FIG. 4 shows a portion of the surface 10 of the female mold section 6 being blasted with a stream 14 of glass beads eminating from spray nozzle 16. FIG. 5A is a draftsman's illustration of the microtopography of the portion 5A of FIG. 4 which has a textured surface according to the present invention. FIG. 5B shows desirable Talysurf profile of portion 5A of FIG. 4 over a sampling length of 4.398 mm with its peaks 18 and valleys 20 extending above and below the mean line 22. FIG. 5C is a 20×photomicrograph of the mold surface that generated the desirable Talysurf profile of FIG. 5B.

Figure 6B:
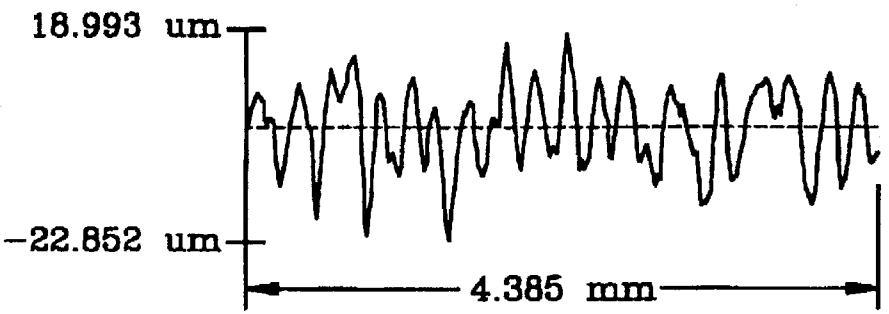
FIG. 6B is the Talysurf profile of the untextured mold cavity surface at site 6A.
Figure 6A:
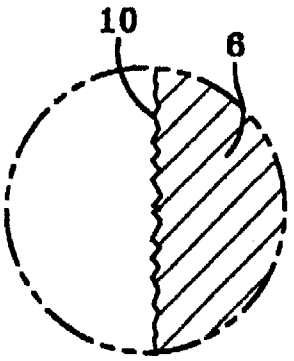
FIG. 6A is a magnified portion of an untextured surface at site 6A of FIG. 4.
Figure 6C:
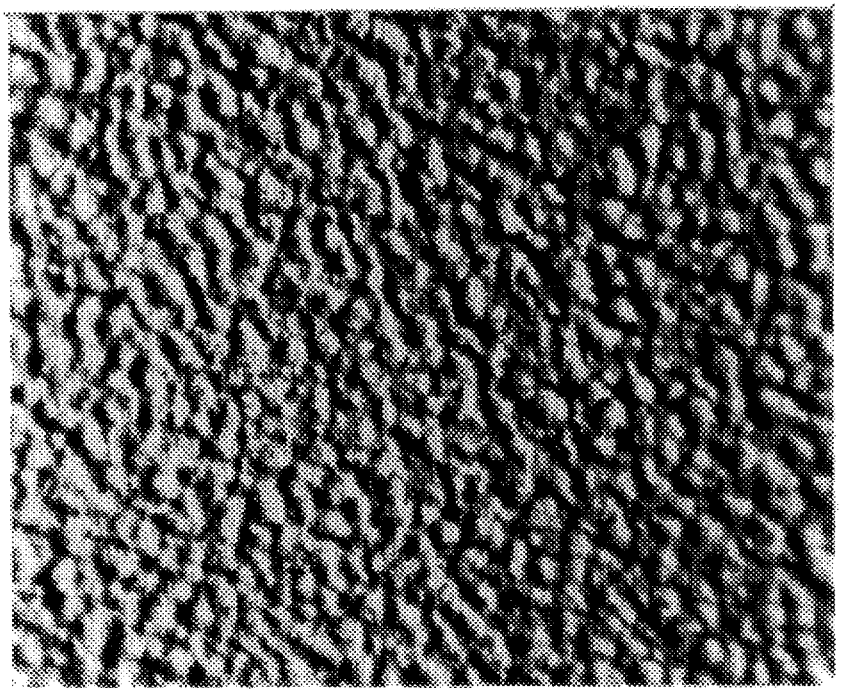
FIG. 6C is a photomicrograph showing the surface 6A at 20×magnification.

FIG. 6A is a draftsman's illustration of the microtopography of the portion 6A of FIG. 4 which is a surface of the mold, as machined, and untextured as called for by the present invention. FIG. 6B shows an undesirable Talysurf profile of portion 6A of FIG. 4 over a sampling length of 4.385 mm. FIG. 6C is a 20×photomicrograph of the mold surface that generated the undesirable Talysurf profile of FIG. 6B.

EXAMPLE

Center core mold sections of a H-13 steel mold for permanent mold casting of aluminum automobile engine pistons were both RPVD coated with a 6μ thick TiAlN coating utilizing a PVD coater made by Multi-Arc Coatings, Inc. Prior to such coating, the mold surface was blasted through a 13 mm nozzle with: (1) an air blast of 100 psi for 3 minutes with 40–70 mesh beads, followed by (2) an air blast of 70 psi for 5 minutes with 100–140 mesh beads, followed by (3) an air blast of 90 psi for 2 minutes with 200–325 mesh beads to produce a surface like that shown in FIG. 5C and characterized in FIG. 5B. The nozzle was spaced about 100 mm from the surface at an impingement angle of 90°. The mold was then cleaned as described above.

Following texturing and cleaning, the piston center core mold was placed in the coater's vacuum chamber along with two (2) Ti targets and two (2) Al targets, and therein heated to 450° C. under a vacuum of $1\times10^{-4}$ Torr. A gas comprising argon and nitrogen was admitted to the chamber, and a source voltage of thirty (30) volts and a source current of three hundred (300) amps applied to vaporize the targets. A biasing voltage of four hundred (400) volts was established between the mold and Ti and Al targets and provided a mold surface current density of six (6) $mA/C^2$. Deposition continued for three (3) hours to deposit a six (6) μ TiAlN layer thereon. The core sections were assembled into a piston mold and 390 aluminum alloy gravity cast therein at a temperature of 750° C. The mold cast about 1600 pistons without misruns before the test was stopped. Similar tests were conducted with piston molds roughened by shotblasting, laser beam melting, and electron discharge machining. All of these latter molds failed due to misruns occurring in the roughened area of the mold throughout the entire test period of about 800 cast pistons.

While the invention has been described in terms of certain embodiments thereof, it is not intended to be limited thereto but rather only to the extent set forth hereafter in the claims which follows.

What is claimed is:

1. A mold for the permanent mold casting of aluminum comprising a metal body having an inner surface defining a molding cavity, and a physical vapor-deposited ceramic coating adhering to said surface, said coating having a thickness between about 2μ and about 20μ and conforming substantially to the microtopography of said surface, said microtopography comprising a plurality of peaks and valleys characterized by a Talysurf Series profile having (a) a mean line above and below which the areas under said peaks and said valleys are equal and a minimum, (b) a maximum height, $R_p$, of said peaks above said mean line of about 9μ to about 13μ, (c) a maximum depth, $R_v$, of said valleys beneath said mean line of about 9μ to about 15μ, (3) a roughness characteristic, $R_a$, of about 3μ to about 5μ, which characteristic is the arithmetic mean of the departures of the profile from the mean line over, and (4) a peak spacing at the mean line, $S_m$, of about 400μ to about 500μ which spacing is the arithmetic mean of the sum of the spacings between the beginning of one peak and the beginning of the next peak at the mean line over a sampling length, divided by the number of such spacings over said length.

2. A mold according to claim 1 wherein said ceramic coating has a thickness less than about eight (8)μ.

3. A mold according to claim 1 wherein said ceramic comprises a metal nitride selected from the group consisting of titanium-aluminum-nitride, titanium nitride, and chromium nitride.

4. A mold according to claim 2 wherein said ceramic coating has a thickness greater than about two (2)μ.

* * * * *